US012071265B2

(12) United States Patent
Jönsson et al.

(10) Patent No.: US 12,071,265 B2
(45) Date of Patent: Aug. 27, 2024

(54) REBAR TYING DEVICE COMPRISING A WIRE LOCKING MECHANISM AND A CONTROL UNIT FOR CONTROLLING THE WIRE LOCKING MECHANISM

(71) Applicant: HUSQVARNA AB, Huskvarna (SE)

(72) Inventors: Andreas Jönsson, Hallsberg (SE); Robert Lerbro, Floda (SE); Magnus Karlsson, Ljungbyholm (SE); Lennart Gustafsson, Rockneby (SE); Torkel Danielsson, Nybro (SE)

(73) Assignee: HUSQVARNA AB, Huskvarna (SE)

( * ) Notice: Subject to any disclaimer, the term of this patent is extended or adjusted under 35 U.S.C. 154(b) by 213 days.

(21) Appl. No.: 17/771,669

(22) PCT Filed: Oct. 26, 2020

(86) PCT No.: PCT/SE2020/051030

§ 371 (c)(1),
(2) Date: Apr. 25, 2022

(87) PCT Pub. No.: WO2021/086253

PCT Pub. Date: May 6, 2021

(65) Prior Publication Data

US 2022/0380073 A1 Dec. 1, 2022

(30) Foreign Application Priority Data

Oct. 28, 2019 (SE) ..... 1951228-4
Oct. 28, 2019 (SE) ..... 1951229-2
Oct. 28, 2019 (SE) ..... 1951230-0

(51) Int. Cl.
*B65B 13/28* (2006.01)
*E04G 21/12* (2006.01)

(52) U.S. Cl.
CPC ..... *B65B 13/285* (2013.01); *E04G 21/123* (2013.01)

(58) Field of Classification Search
CPC ..... B21F 15/00; B21F 15/02; B21F 15/04; B65B 13/22; B65B 13/28; B65B 13/285;
(Continued)

(56) References Cited

U.S. PATENT DOCUMENTS 5,279,336 A 1/1994 Kusakari et al.
2009/0283170 A1 11/2009 Nagaoka
2019/0093374 A1 3/2019 Machida et al.

FOREIGN PATENT DOCUMENTS

CA 2937347 A1 11/2009
CN 1151129 A 6/1997
(Continued)

OTHER PUBLICATIONS

Translation of JP-2018109297 (Year: 2018).*
(Continued)

*Primary Examiner* — Bobby Yeonjin Kim
(74) *Attorney, Agent, or Firm* — Burr & Forman LLP

(57) ABSTRACT

A wire locking mechanism (200, 300, 400, 500, 600, 700) for a reinforcement bar, rebar, wire tying device (100), the locking mechanism comprising (200, 300, 400, 500, 600, 700) a holding member (210, 310) and a counter-holding member (220, 320) arranged to engage respective and opposite sides of a wire (230) to releasably hold the wire (230) in a locking position, where a holding force exerted on the wire (230) by the holding member (210, 310) is normal to a holding plane (A2), wherein the holding member (210, 310) is supported on a first end of an excentre arm (240, 340), the excentre arm (240, 340) being rotatably supported on a first shaft (250, 350) to rotate (R1) about an excentre arm center of rotation (255, 355), wherein the holding
(Continued)

member (210, 310) is arranged distanced (D) along a first axis (A1) from the excentre arm center of rotation (255, 355), the first axis (A1) forming an acute angle (A) with the holding plane (A2) when in the locking position.

7 Claims, 5 Drawing Sheets

(58) Field of Classification Search
CPC ..... B65B 13/025; B65B 13/04; B65B 13/06; B65B 27/10; B25B 25/00; E04G 21/123
See application file for complete search history.

(56) References Cited

FOREIGN PATENT DOCUMENTS

| | | | | | |
|---|---|---|---|---|---|
| CN | 1175929 | A | | 3/1998 | |
| CN | 103619710 | A | | 3/2014 | |
| CN | 107709166 | A | | 2/2018 | |
| CN | 109689505 | A | | 4/2019 | |
| EP | 0751270 | A1 | * | 1/1997 | ..... E04G 21/12 |
| EP | 1415917 | A | | 5/2004 | |
| EP | 2666932 | A1 | | 11/2013 | |
| JP | H06008910 | A | | 1/1994 | |
| JP | 2001038647 | A1 | | 2/2001 | |
| JP | 2009275485 | A | | 11/2009 | |
| JP | 2017206923 | A | | 11/2017 | |
| JP | 2018109297 | A | * | 7/2018 | ..... B21F 15/04 |
| JP | 2019526509 | A | | 9/2019 | |
| WO | 2009142210 | A1 | | 11/2009 | |
| WO | 2017014266 | A1 | | 1/2017 | |
| WO | 2018186794 | A1 | | 10/2018 | |

OTHER PUBLICATIONS

Swedish Search Report in Swedish patent application No. 1951228-4, dated Mar. 3, 2020.
International Search Report and Written Opinion in PCT Application No. PCT/SE2020/051030, dated Dec. 7, 2020.
Swedish Search Report in Swedish patent application No. 1951229-2, dated Mar. 3, 2020.
Swedish Search Report in Swedish patent application No. 1951230-0, dated Mar. 3, 2020.

* cited by examiner

REBAR TYING DEVICE COMPRISING A WIRE LOCKING MECHANISM AND A CONTROL UNIT FOR CONTROLLING THE WIRE LOCKING MECHANISM

TECHNICAL FIELD

The present disclosure relates to wire tying devices for tying reinforcement bars (rebars) together to form a rebar structure for reinforcing, e.g., concrete and other solidifiable materials.

BACKGROUND

Concrete is strong under compression but often has relatively weak tensile strength. Reinforcing bars, or rebars, are therefore often used to strengthen concrete structures, where they significantly increase the tensile strength of the concrete.

The most common type of rebar is carbon steel, typically consisting of hot-rolled round bars with deformation patterns. Other readily available types include stainless steel, and composite bars made of glass fibre, carbon fibre, or basalt fibre. The steel reinforcing bars may also be coated in an epoxy resin designed to resist the effects of corrosion mostly in saltwater environments, but also in land-based constructions.

The rebar elements are normally connected into a rebar structure or lattice by tying the elements together with steel wire. For tying epoxy coated or galvanised rebars, epoxy coated, or galvanized wire is normally used. The wire may also be coated in plastic or the like to prevent corrosion.

Due to the large number of connection points between rebar elements in a larger rebar structure, it is desired to automate the wire tying.

EP 2666932 B1 discloses an automatic wire tying device for tying rebars together.

It is important that the rebars are firmly connected together and that the wire knots are taut. Achieving a sufficiently tight knot may be a problem when using automatic wire tying devices, especially if the wire is slippery due to, e.g., water, ice and/or oil on the wire. A further problem relates to if the wire has an uneven thickness that varies along the wire length, since this complicates, e.g., calibrating an automatic wire tying device locking mechanism.

There is a need for improved automatic rebar wire tying devices.

SUMMARY

It is an object of the present disclosure to provide improved automatic rebar wire tying devices. This object is at least in part obtained by a wire locking mechanism for a rebar wire tying device. The locking mechanism comprises a holding member and a counter-holding member arranged to receive a free end of a wire and to engage respective sides of the wire to releasably hold the wire in a locking position, where a holding force exerted on the wire by the holding member is normal to a holding plane. The holding member is supported on a first end of an excentre arm. The excentre arm is rotatably supported on a first shaft to rotate about an excentre arm center of rotation, wherein the holding member is arranged distanced along a first axis from the excentre arm center of rotation, the first axis forming an acute angle with the holding plane when in the locking position, wherein at least one of the holding member and the counter-holding member comprises a rotatably supported toothed wheel.

This way even slippery wires are held firmly during knot formation. The excentre arm arrangement provides for an increased holding as the wire is pulled out from the locking mechanism. The wire can, however, be released in a controlled manner by separating the holding member from the counter-holding member.

According to aspects, the holding member comprises a first toothed wheel rotatably supported on a second shaft, and a catch arrangement configured to lock the first toothed wheel when in the locking position. Thus, the wire can be released in a precise manner, and there is a limited amount of build-up of wire shavings as the wire is released, since the wire does not shave against, e.g., a holding pad or the like.

According to aspects, the first toothed wheel comprises teeth with a circumferentially blunt and/or essentially flat portion configured to engage the wire when in the locking position. The circumferentially blunt and/or essentially flat portion reduces the risk of the wire braking during knot formation when the wire is held by the locking mechanism, since a blunt tooth does not cut into the wire in the way a more sharp tooth would.

According to aspects, the counter-holding member comprises a second toothed wheel rotatably supported on a third shaft. The teeth on the second toothed wheel increases the ability of the mechanism to hold on to wires of varying thickness. The acute angle can also be formed more aggressively due to the teeth on the second toothed wheel, since now two wheels with teeth hold the wire in the locked position. The second toothed wheel further reduces build-up of wire shavings.

According to aspects, the wire locking mechanism comprises a first actuator arranged to rotate the excentre arm about the excentre arm center of rotation in a first direction to separate the holding member from the counter-holding member when in a wire-infeed mode. This way the wire can more easily enter into locking contact with the holding member and the counter-holding member, thereby simplifying the tying operation.

According to aspects, the wire locking mechanism comprises a second actuator arranged to rotate the excentre arm about the excentre arm center of rotation in a second direction opposite to the first direction to move the holding member into the locking position. The second actuator allows for efficient control of the mechanism, in particular, the mechanism can be placed in locking position by means of the second actuator.

According to aspects, the first actuator and/or the second actuator comprises a solenoid device. A solenoid device is a cost-effective control means which can be controlled electrically by, e.g., a control unit.

According to aspects, the excentre arm and the counter-holding member are supported on a joining member, wherein the joining member is rotatably supported on a fourth shaft to rotate in relation to a locking mechanism body in response to a pull force acting on the wire. This way the resulting knot on the wire becomes tighter, since the locking mechanism is able to align with a pull force acting on the wire during the knot tying operation, thereby minimizing any bends on the wire which contribute negatively to knot tightness.

According to aspects, the wire locking mechanism also comprises a control arm arrangement. The control arm arrangement comprises an engagement surface for engaging a cylinder cam, whereby, upon rotation of the locking mechanism body to a pre-determined angle, the control arm arrangement is configured to release the catch arrangement, thereby placing the first toothed wheel in a free rolling condition and releasing the wire from the wire locking mechanism. The control arm arrangement with the cylinder cam allows for a very precise timing of the release operation. This precise timing simplifies knot formation and reduces risk of the wire braking when tying the knot. The precise timing allows for forming tight knots with minimum slack, which is an advantage.

According to aspects, the engagement surface for engaging the cylinder cam comprises a cylindrical roller configured to traverse the cylinder cam. The roller reduces friction, which is an advantage.

There are also disclosed herein wire tying devices and control units associated with the above mentioned advantages.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. Further features of, and advantages with, the present invention will become apparent when studying the appended claims and the following description. The skilled person realizes that different features of the present invention may be combined to create embodiments other than those described in the following, without departing from the scope of the present invention.

BRIEF DESCRIPTION OF THE DRAWINGS

The present disclosure will now be described in more detail with reference to the appended drawings, where.

DETAILED DESCRIPTION

Figure 1:
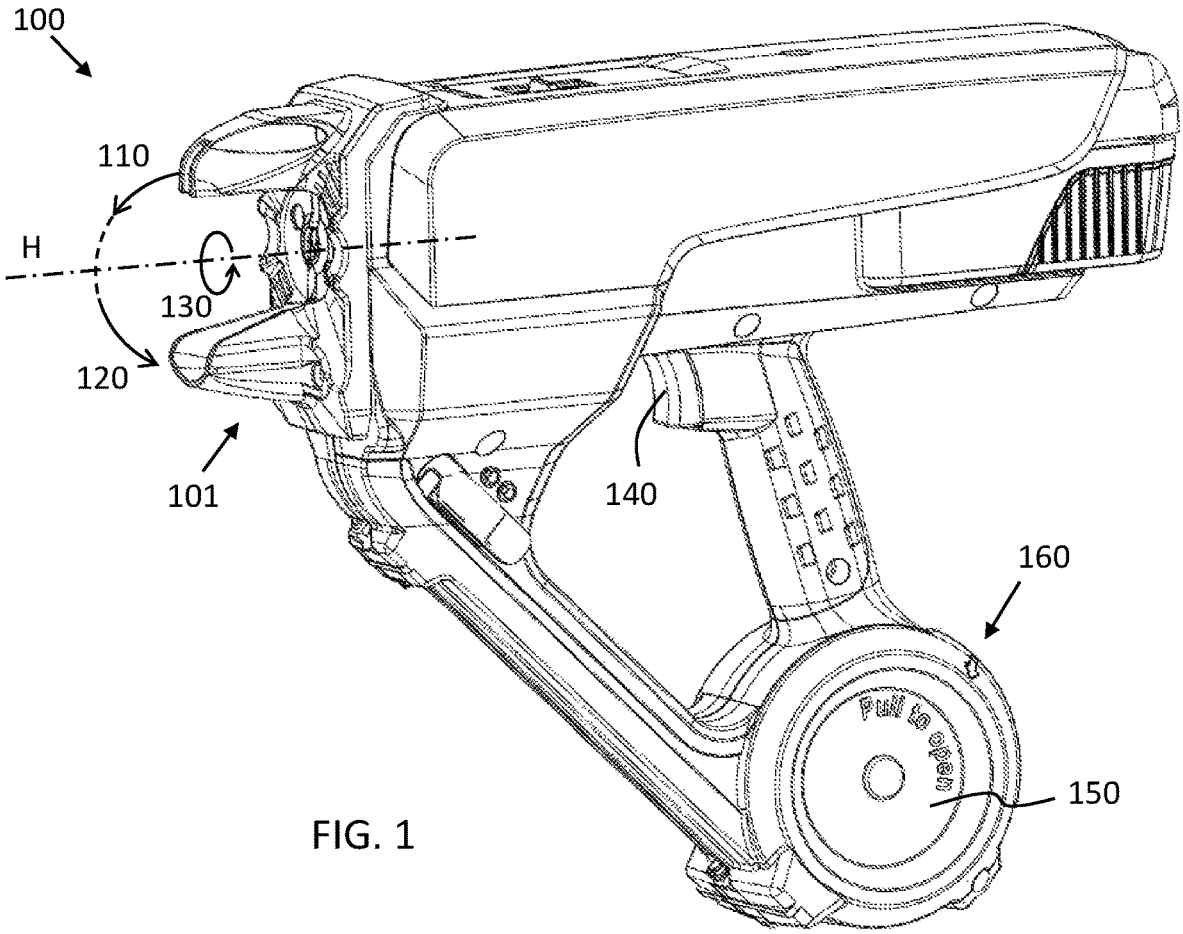
FIG. 1 shows an example wire tying device.

The invention will now be described more fully hereinafter with reference to the accompanying drawings, in which certain aspects of the invention are shown. This invention may, however, be embodied in many different forms and should not be construed as limited to the embodiments and aspects set forth herein; rather, these embodiments are provided by way of example so that this disclosure will be thorough and complete, and will fully convey the scope of the invention to those skilled in the art. Like numbers refer to like elements throughout the description.

It is to be understood that the present invention is not limited to the embodiments described herein and illustrated in the drawings; rather, the skilled person will recognize that many changes and modifications may be made within the scope of the appended claims.

FIG. 1 shows a wire tying device 100 for tying wire knots that secure a rebar structure. The wire tying device is arranged to feed 110 a free end of a wire out from an opening in a tying head 101 of the device. The wire is rolled prior to being fed out from the wire tying head 101, and therefore assumes an arcuate form due to the rolling inside the tying head 101. EP 2666932 discusses rolling wire such that it extends in an arcuate form when exiting a wire tying head. Rolling arrangements for rolling rebar tying wire will therefore not be discussed in more detail herein.

Herein, the wire has a free end. This is the end of the wire which is feed out from the tying head 101 and then received back in the tying head, not the end of the wire which is left on the wire spool or other wire storage means.

The wire extends along an arcuate path to encircle the rebars (not shown in FIG. 1) which are to be tied together and is then received 120 back in the tying head 101, where it is held by a wire locking mechanism which will be discussed in detail below.

The wire locking mechanism body comprised in the wire tying head 101 is then brought to rotate 130 about a wire tying head axis H, which rotation forms a knot on the wire. The wire tying device 100 is also arranged to cut the wire.

The whole process is automatically executed in sequence when the wire tying device is triggered by an operator using a trigger 140. A length of wire is stored on a spool 150 comprised in a spool compartment 160 of the wire tying device.

Thus, the wire tying device 100 allows for conveniently an efficiently tying together rebar structures.

A problem when tying rebars together is that the wire sometimes is hard to hold fixedly by the wire locking mechanism during formation of the knot. The wire may, e.g., be slick from oil, water, ice and the like, causing it to slip in the locking mechanism. Such slipping often results in a loose knot, which is not desired since too many loose knots lead to a non-rigidly assembled reinforcement structure. Also, slipping wires tend to cause build-up of wire particles inside the wire tying head, since the slipping wire shaves or is abraded by the locking mechanism as it slips.

Also, the wire must be released at the exact right time in the tying process, since otherwise the wire may brake at the wrong time, causing a failed knot. This is because tension forces in the wire increases during rotation 130 of the wire tying head. It may be a problem to achieve sufficient release timing accuracy.

Figure 2:
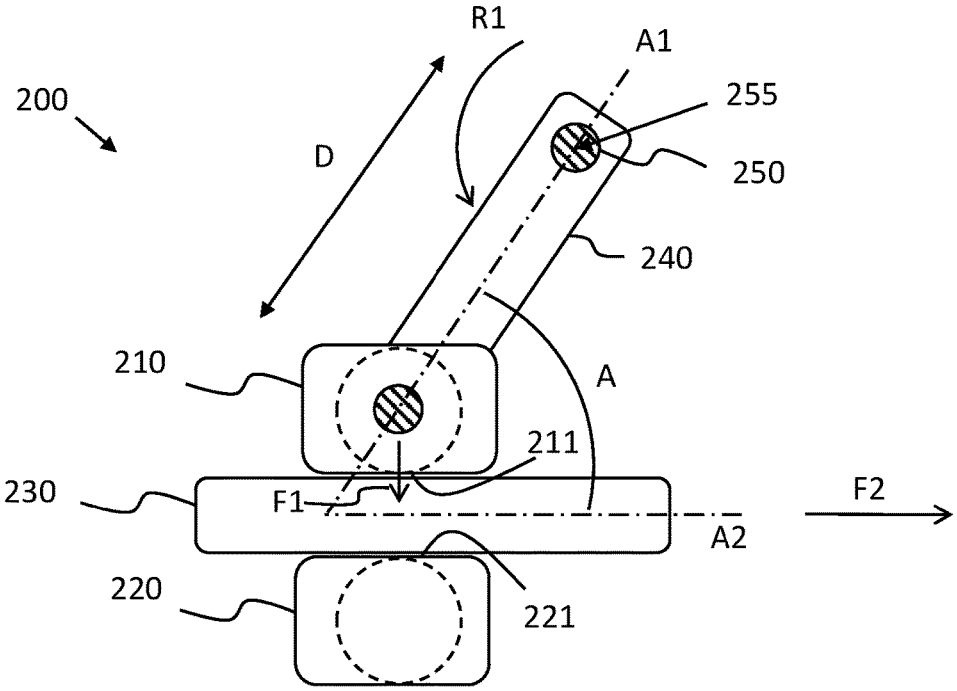
FIG. 2 schematically illustrates a wire locking mechanism.

FIG. 2 illustrates a wire locking mechanism 200 for a rebar wire tying device such as the device 100. The locking mechanism comprises a holding member 210 and a counter-holding member 220 arranged to receive a free end of a wire 230 and to engage respective sides of the wire 230 to releasably hold the wire in a locking position. Normally, the holding member 210 and the counter-holding member 220 are arranged to engage opposite sides of the wire 230, but this is not necessary as the holding member may engage the wire at an angle with respect to the counter-holding member.

To hold the wire 230 in locking position means that the wire is able to resist a pull force F2, pulling the wire out from the wire tying head, without significant slipping. The pull force F2 on the wire is generated, e.g., by running the wire feed mechanism of the wire tying device 100 in reverse.

A holding force F1 exerted on the wire 230 by the holding member 210 is normal to a holding plane A2 extending between holding surfaces 211, 221 of the holding member and the counter-holding member.

To releasably hold the wire means that the holding force can be reduced at a pre-determined time instant during the tying process, whereby the wire is released from the wire locking mechanism.

Optionally, the holding surfaces 211, 221 of any of the holding and/or counter-holding member comprises friction increasing means such as serrations or resilient coatings, e.g., rubber coating. The holding member 210 and/or the counter-holding member 220 may be arranged as toothed wheels, which will be discussed in detail below.

The holding member 210 is supported on a first end of an excentre arm 240. The excentre arm 240 is rotatably supported on a first shaft 250 to rotate in direction R1 about an excentre arm center of rotation 255. The holding member 210 is arranged distanced D along a first axis A1 from the excentre arm center of rotation 255. This means that the holding force F1 develops as the excentre arm 240 is rotated about the excentre arm center of rotation 255 in counter-clockwise direction when viewed as in FIG. 2. The first axis A1 forms an acute angle A with the holding plane A2 when in the locking position.

The excentre arm 240 together with the holding member 210 and the counter-holding member 220 form an excentre locking mechanism which holds the wire in response to the pull force F2. If the pull force F2 increases, then the friction between the wire 230 and the holding member causes the excentre are 240 to want to rotate in direction R1 shown in FIG. 2. This moment results in an increased holding force F1. Thus, the harder the wire is pulled—the more firmly it is held by the wire locking mechanism. Also, a reduced pull force F2 results in a reduced holding force F1. The wire locking mechanism can be opened, and the wire released, by rotating the excentre arm clockwise about the excentre arm center of rotation 255, i.e., in a direction opposite to direction R1.

At least one of the holding member 210 and the counter-holding member 220 comprises a rotatably supported toothed wheel (illustrated in FIG. 2 by dashed circles). This at least one toothed wheel allows for holding wires of varying dimension, and also allows for releasing the wire without shaving material off from the wire, due to the rotation of the wheel.

In case only one of the holding member 210 and the counter-holding member 220 comprises a rotatably supported toothed wheel, the other may comprise, e.g., a supporting surface or the like. A holding member 210 not comprising a rotatably supported toothed wheel may be integrally formed with the excentre arm 240, i.e., a portion of the excentre arm 240.

Figure 3:
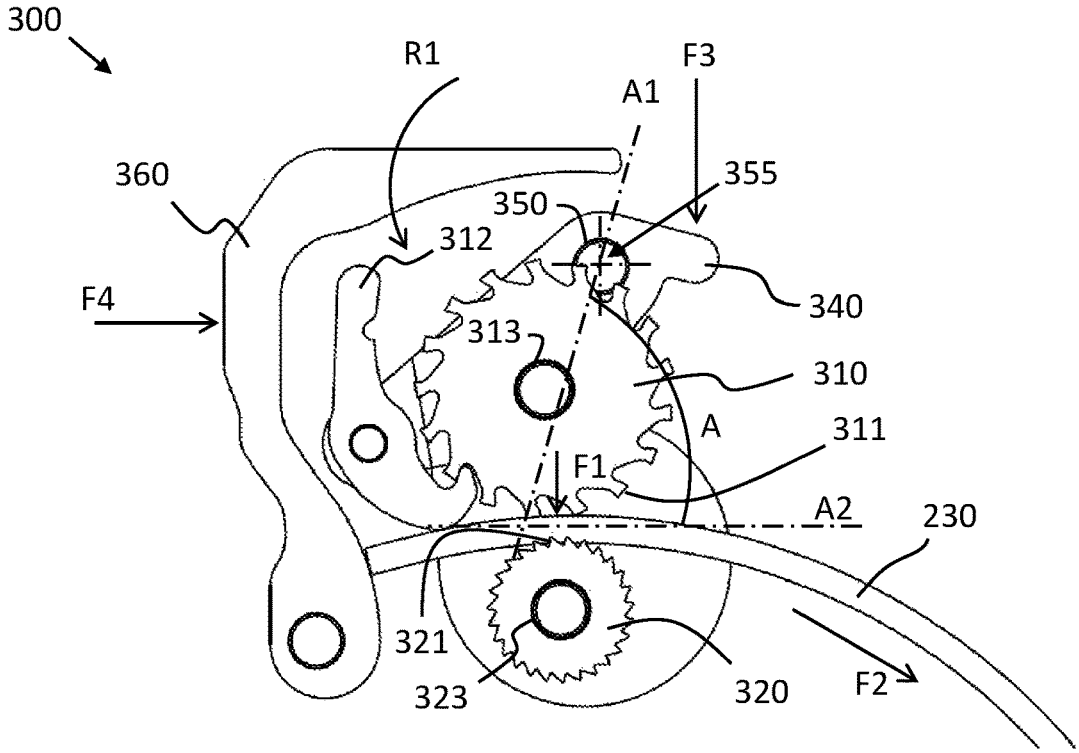
FIGS. 3-4 illustrate details of example wire locking mechanisms.

FIG. 3 shows an example embodiment of the wire locking mechanism 300. The holding member here comprises a first toothed wheel 310 rotatably supported on a second shaft 313, and a catch arrangement 312 configured to lock the first toothed wheel when in the locking position. The catch arrangement 312 is supported on the excentre arm 340 and therefore rotates together with the first toothed wheel 310.

According to aspects, the counter-holding member 320 comprises a second toothed wheel rotatably supported on a third shaft 323. However, it is appreciated that the counter-holding member 320 may also comprise, e.g., a heel, block, or other fixed support.

The catch arrangement can of course also be configured to lock the second toothed wheel 320 instead of the first toothed wheel 310. There may also be one catch arrangement arranged per toothed wheel.

The teeth on the second toothed wheel increases the ability of the mechanism to hold on to wires of varying thickness along the wire length. The angle A, shown in, e.g., FIG. 1, can be formed more aggressively due to the teeth on the second toothed wheel, since now two wheels with teeth hold the wire in the locked position.

With reference to FIG. 3, an opening between the holding member 310 and the counter-holding member 320 can be created by rotating the excentre arm 340 in a direction opposite to the rotation direction R1. The wire 230 can then be received between the holding member and the counter-holding member more easily.

Optionally, the catch arrangement 312 is spring loaded towards a position to lock the first toothed wheel.

The second toothed wheel 320 making up the counter-holding member may be free-rolling, but as long as the catch arrangement 312 is in locking contact with the first toothed wheel 310, and the wire 230 contacts both the first and the second toothed wheel, the locking mechanism 300 is in locking position. A holding force F1 will develop in response to a pull force F2 on the wire to hold the wire firmly even if the wire is slippery due to, e.g., oil or ice.

According to aspects, the first toothed wheel 310 comprises teeth with a circumferentially blunt and/or essentially flat portion 311 configured to engage the wire 230 when in the locking position. The blunt portions spare the wire from the cutting or shearing force exerted by the teeth on the toothed wheel on the wire when the holding force F1 is developed.

According to some aspects, the length of the teeth on the second wheel 320 is set in dependence of the wire thickness so as to not accidentally cut the wire by the holding force F1.

The different components of the wire locking mechanism may be spring loaded so as to be biased towards respective default positions. The spring biasing may be achieved using, e.g., torsion springs. For instance, the excentre arm 240, 340 may be spring loaded towards the locking position and the catch arrangement 312 may be spring loaded towards a locking contact with the first toothed wheel 310.

Alternatively, or in combination, the catch arrangement may be spring loaded towards a locking contact with the second toothed wheel 320. It is again appreciated that any of the first and second toothed wheel, or both, can be arranged to be locked by a catch arrangement. There may be one, two, or more catch arrangements configured to lock toothed wheels when in the locking position.

In general, to operate the wire locking mechanisms 200, 300, the wire locking mechanism optionally comprises a first actuator arranged to rotate the excentre arm 240, 340 about the excentre arm center of rotation 255, 355 in a first direction (opposite to direction R1 in FIGS. 2 and 3) to separate the holding member 210, 310 from the counter-holding member 220, 320 when in a wire-infeed mode.

The wire locking mechanisms 200, 300 optionally also comprise a second actuator arranged to rotate the excentre arm 240, 340 about the excentre arm center of rotation 255, 355 in a second direction R1 opposite to the first direction to move the holding member 210, 310 into the locking position.

The first actuator and/or the second actuator may, e.g., comprise respective solenoid devices configured to exert forces F3, F4 on the excentre arm. EP 2666932 B1 discusses such actuators. However, other actuators, such as actuators based on magnetic force, may also be used to control the wire locking mechanism.

A control arm arrangement 360 shown in FIG. 3 may be used to both engage and release the catch arrangement 312, as will be discussed in more detail below in connection to FIGS. 9-12. The control arm arrangement 360 may also be used to force the excentre arm 340 to rotate in direction R1 towards the locking position. A solenoid device may be used to push onto the control arm arrangement, i.e., to exert a force F4.

Figure 4:
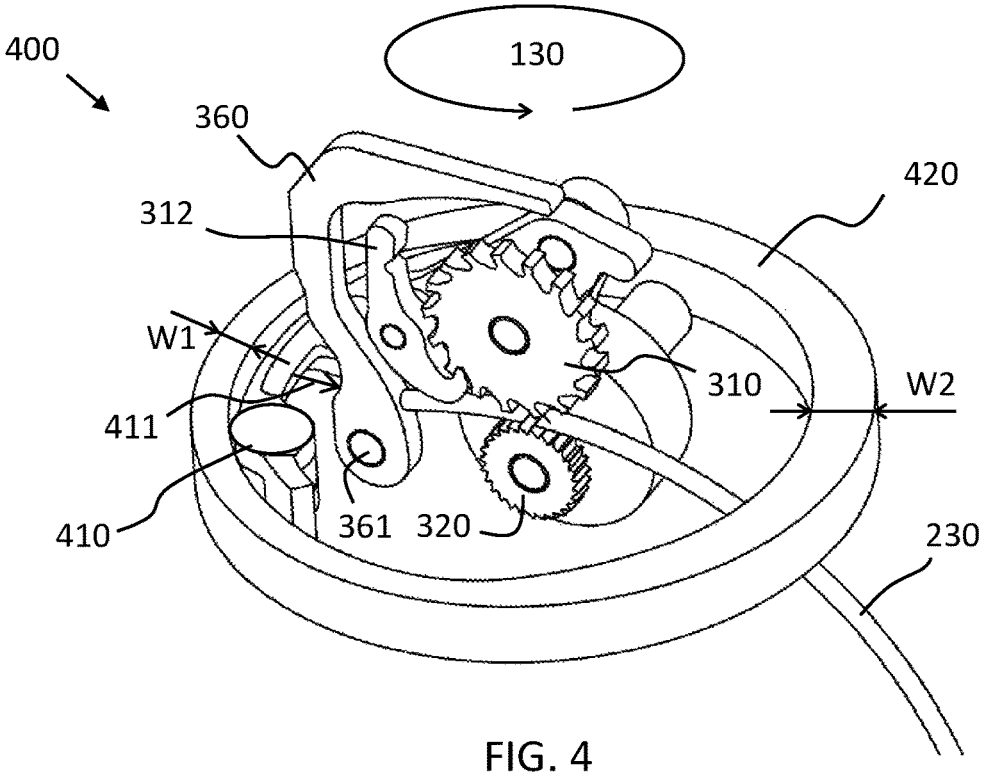

It is, as noted above, preferred to release the wire from the wire locking mechanism with accurate timing so as to not break the wire during the tying operation. FIG. 4 shows details of a wire locking mechanism 400 which comprises a control arm arrangement 360. The control arm arrangement 360 comprises an engagement surface 410 for engaging a cylinder cam 420, whereby, upon rotation of the locking mechanism body 530 (shown in FIG. 7) to a pre-determined angle. The control arm arrangement 360 is configured to release the catch arrangement 312, thereby placing the first toothed wheel 310 in a free rolling condition and releasing the wire 230 from the wire locking mechanism.

Figure 7:
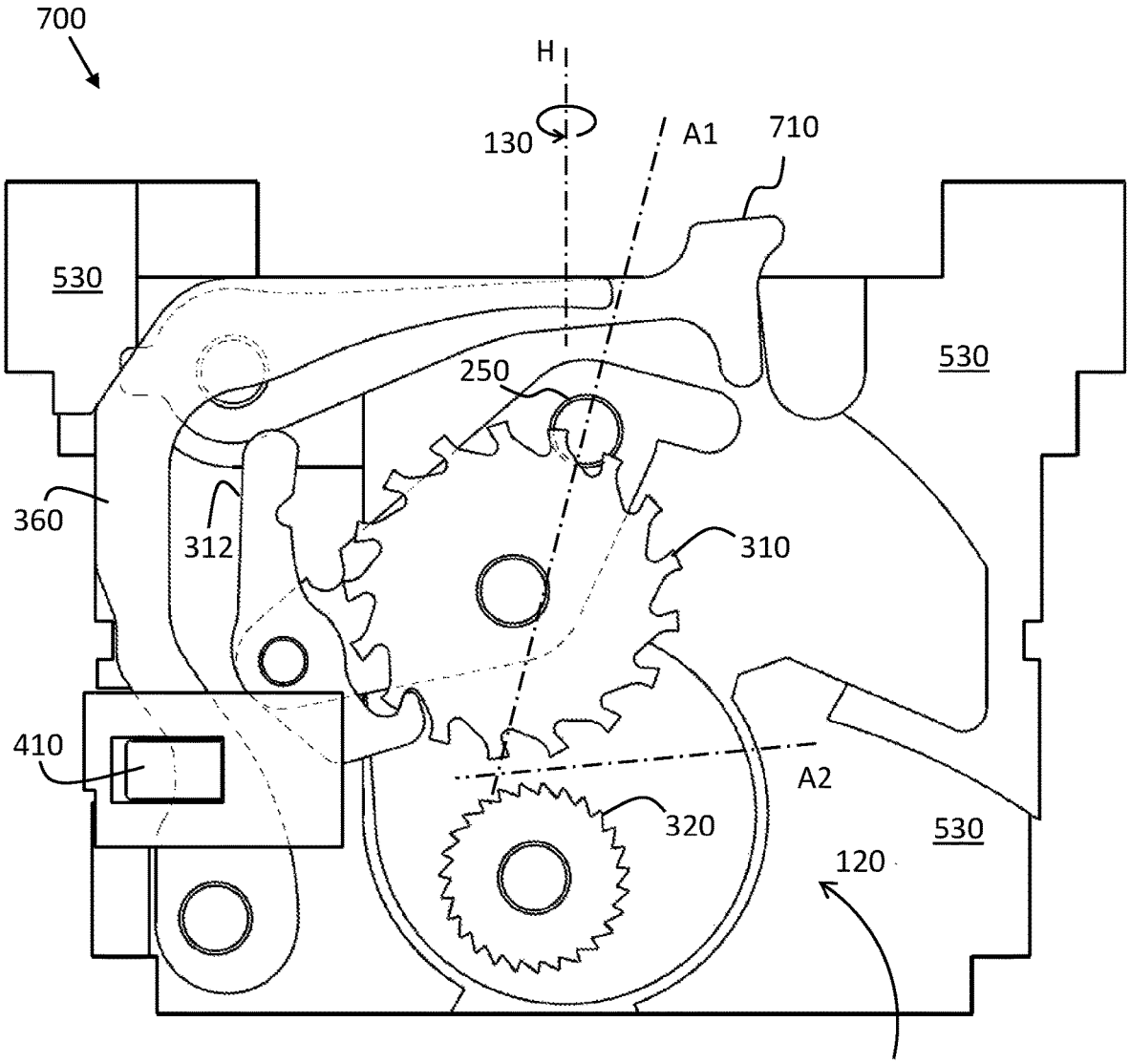
FIG. 7 shows an example wire locking mechanism assembled with a body.

With reference to FIGS. 4 and 7, the cylinder cam 420 allows for a precise control of the release of the wire locking mechanism 400. By varying the cam width W1, W2, the pushing force F4 on the control arm arrangement 360 can be accurately synchronized with a rotation of the locking mechanism body during tying operation. The locking mechanism body 530 starts in a position where the cam width W1 is relatively small and therefore exerts no force 411 on the control arm arrangement 360. As the locking mechanism body rotates, the width increases up to a width W2, and the control arm arrangement then moves in direction of the catch arrangement 312 to release the catch, thereby releasing the first toothed wheel 310.

It is an advantage that the first and second toothed wheels are in free rolling condition as the wire is released, since this minimizes abrasion by the holding members on the wire 230, thereby preventing build-up of wire particles inside the wire tying head 101.

According to some aspects, the engagement surface 410 for engaging the cylinder cam 420 comprises a cylindrical roller configured to traverse the cylinder cam 420. The roller reduces friction and therefore provides for a smoother knot tying operation. In other words, the control arm arrangement 360 comprises an engagement surface 410, which may be a roller bearing. The control arm 360 is pivotably arranged about an axis 361.

Figure 5:
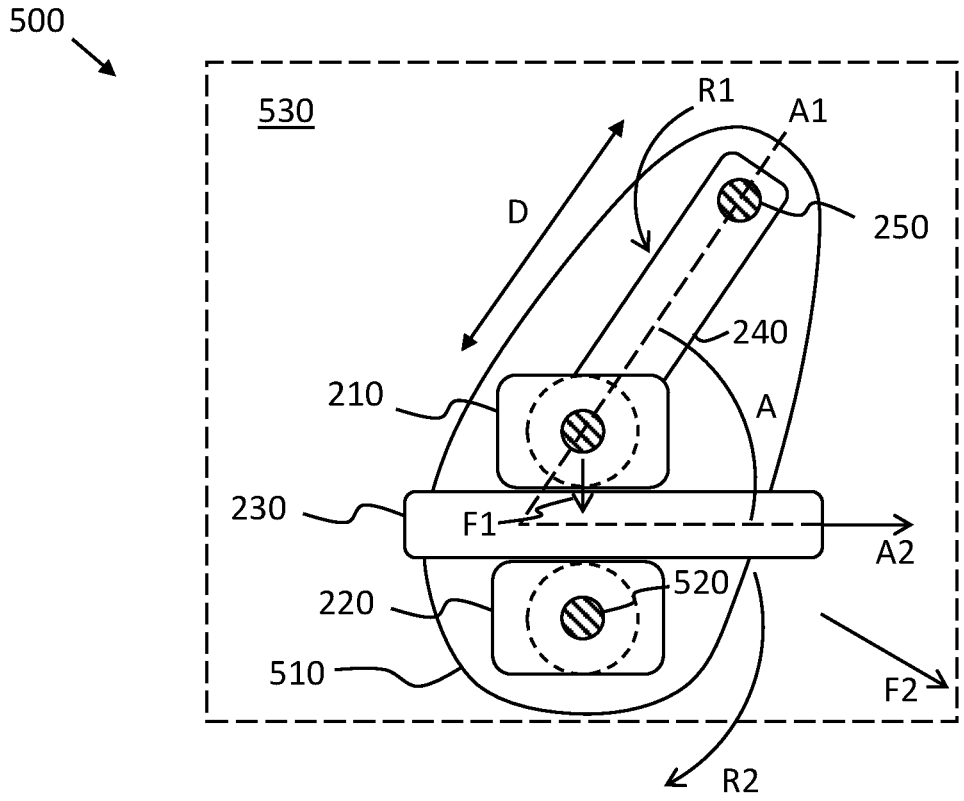
FIG. 5 schematically illustrates a rotatable wire locking mechanism.

It is important that the wire 230 is not subject to an unnatural arcuate form during the tying operation, as this may result in a loose knot. With reference to FIG. 3, such an arcuate form may result if the pull force F2 on the wire 230 is not aligned with the holding plane A2. With reference to FIG. 5; To reduce this effect, the wire locking mechanism may be arranged rotatable with respect to the locking mechanism body 530. This way, the whole locking mechanism will respond to a pull force on the wire by rotating R2 the holding plane A2 to be more aligned with the direction of a pull force F2. The wire locking mechanism may be spring-loaded towards a default position for receiving the wire.

Figure 6:
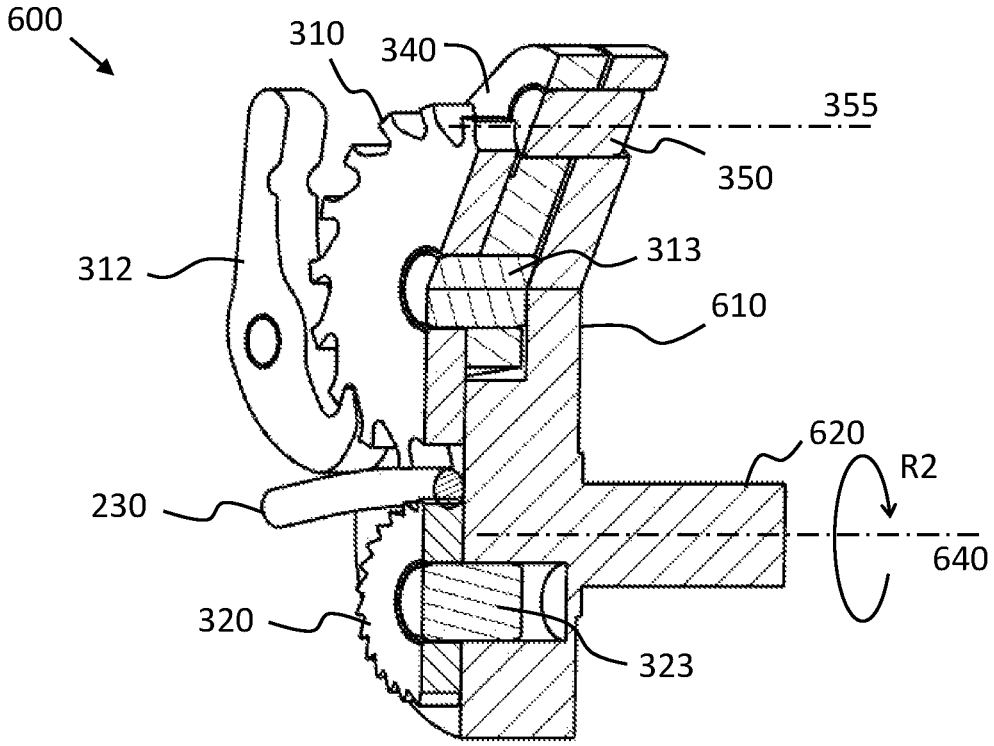
FIG. 6 illustrates an example rotatable wire locking mechanism.

Having this in mind, FIGS. 5 and 6 schematically illustrate a wire locking mechanism 500, 600 according to some aspects of the present disclosure. The excentre arm 340 and the counter-holding member 320 are supported on a joining member 510, 610, wherein the joining member 510, 610 is rotatably supported on a fourth shaft 520, 620 to rotate in relation to a locking mechanism body 530 in response to a pull force F2 acting on the wire 230. It is appreciated that this rotating feature is applicable also to the more general locking mechanism 200 illustrated in FIG. 2.

Figure 8:
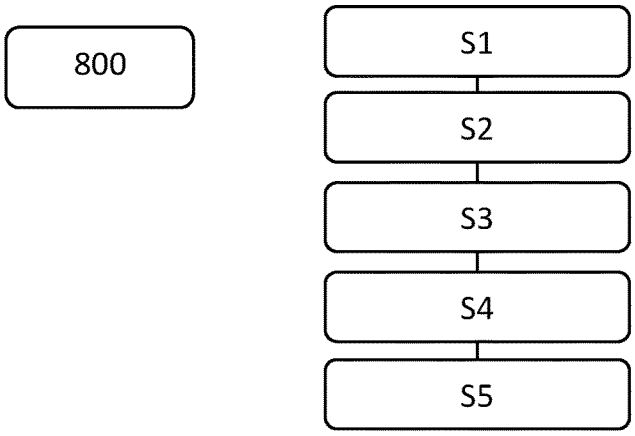
FIG. 8 is a flow chart illustrating methods.
Figure 9:
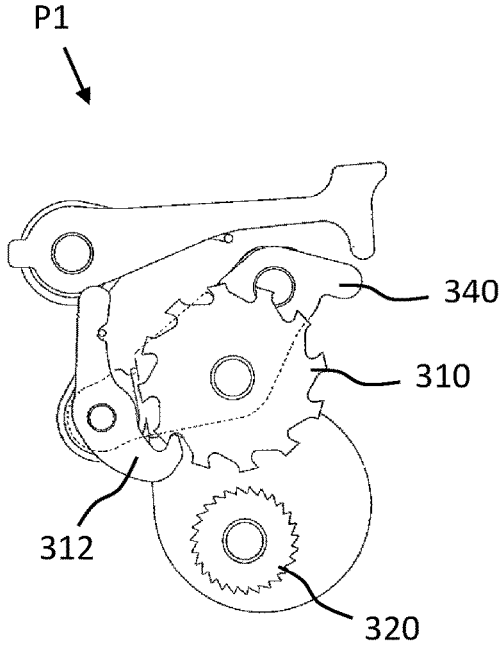
FIG. 9 shows an example locking mechanism in neutral position.

FIG. 8 is a flow chart illustrating a method and a control unit 800 configured to perform the method. The control unit 800 is configured to control a wire locking mechanism 200, 300, 400, 500, 600, 700 for a rebar wire tying device 100.

With reference to FIGS. 9-12, the control unit is configured to transition S1 the wire locking mechanism from a neutral position P1 into a wire infeed mode position P2. As discussed above, the wire locking mechanism may be spring-loaded or otherwise biased towards a neutral position P1 shown in FIG. 9 where the excentre arm 340 is rotated to separate the holding member 310 from the counter-holding member 320, and the catch arrangement is in locking contact with the first toothed wheel.

Figure 10:
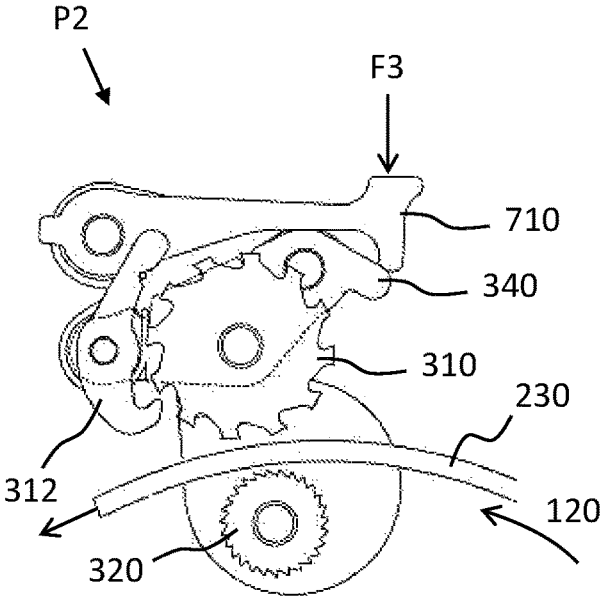
FIG. 10 shows an example locking mechanism in wire infeed mode.
Figure 11:
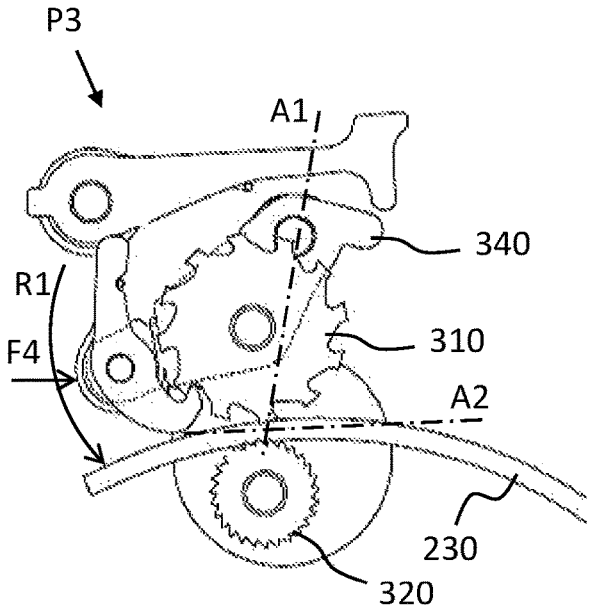
FIG. 11 shows an example locking mechanism in wire locking mode.

The control unit then controls S2 wire feed by the wire tying device 100 to receive a wire 230 in the wire locking mechanism 200, 300, 400, 500, 600, 700. The wire is rolled prior to exiting the wire tying head, and therefore encircles the rebars to be tied together. FIG. 10 illustrates the wire locking mechanism in wire-infeed mode P2. The excentre arm 340 is rotated by means of, e.g., a solenoid device acting on a link arm 710 to generate the force F3.

Note that the catch arrangement 312 is released when the locking mechanism is in the wire-infeed mode P2. This release can be achieved, e.g., by means of the control arm 360 discussed above. The wire 230 is able to enter between the holding member 310 and the counter-holding member 320 easily due to the free-rolling state of the toothed wheels in the wire-infeed mode P2.

The control unit then transitions S3 the wire locking mechanism from the wire infeed mode P2 into a locking position P3, where the wire is held between the holding member 310 and the counter-holding member 320. To transition the locking mechanism into the locking position P3, the excentre arm 340 is caused to rotate in direction R1 by means of, e.g., the solenoid device and the control arm discussed above.

The locking mechanism then rotates in direction R2 in response to a pull force on the wire 230. The pull force on the wire is generated by running the wire feed mechanism of the wire tying device in reverse. This rotation helps ensure that the knot is tight.

Figure 12:
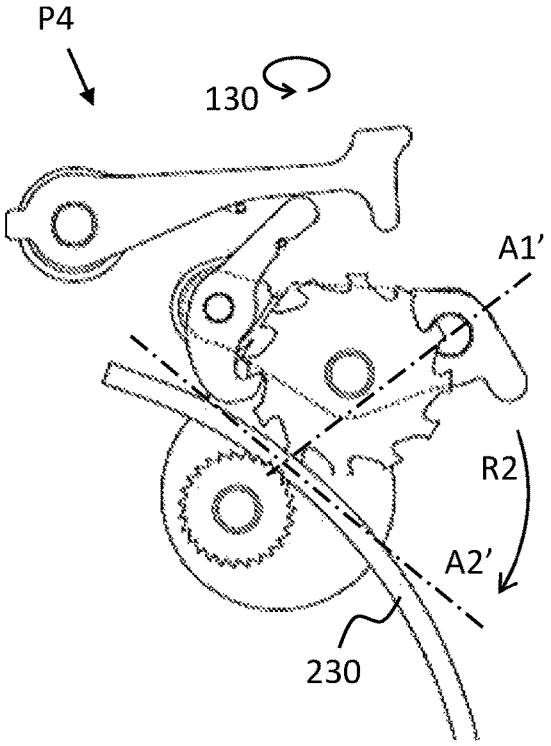
FIG. 12 shows an example locking mechanism during wire tensioning.

FIG. 12 shows a locking mechanism in rotated mode P4, after rotating in direction R2. The first axis A1 after rotation is denoted A1' and the holding plane after rotation is denoted A2'.

The control unit then rotates S4 130 the locking mechanism body 530 to tie a knot on the wire 230 and, at a pre-determined angle of rotation, the wire is released S5 from the wire locking mechanism.

Many of the features disclosed above may be implemented independently from each other. For instance, with reference mainly to FIGS. 5 and 6, there is also disclosed herein a wire locking mechanism 500, 600 for a reinforcement bar, rebar, wire tying device 100, the locking mechanism comprising a holding member 210, 310 and a counter-holding member 220, 320 arranged to engage respective and opposite sides of a wire 230 to releasably hold the wire in a locking position, where a holding force F1 exerted on the wire 230 by the holding member 210, 310 is normal to a holding plane A2, wherein the holding member 210, 310 is supported on a first end of an excentre arm 240, 340, the excentre arm 240, 340 being rotatably supported on a first shaft 250, 350 to rotate R1 about an excentre arm center of rotation 255, 355, wherein the holding member 210, 310 is arranged distanced D along a first axis A1 from the excentre arm center of rotation 255, 355, the first axis A1 forming an acute angle A with the holding plane A2 when in the locking position, wherein the excentre arm 240, 340 and the counter-holding member 220, 320 are supported on a joining member 510, 610, wherein the joining member 510, 610 is rotatably supported on a fourth shaft 520, 620 to rotate in relation to a locking mechanism body 530 in response to a pull force F2 acting on the wire 230.

With reference mainly to FIGS. 5 and 6, there is furthermore disclosed herein a wire locking mechanism 400, 700 for a reinforcement bar, rebar, wire tying device 100, the locking mechanism comprising a holding member 210, 310 and a counter-holding member 220, 320 arranged to engage respective and opposite sides of a wire 230 to releasably hold the wire in a locking position, where a holding force F1 exerted on the wire 230 by the holding member 210, 310 is normal to a holding plane A2, wherein the holding member 210, 310 is supported on a first end of an excentre arm 240, 340, the excentre arm 240, 340 being rotatably supported on a first shaft 250, 350 to rotate R1 about an excentre arm center of rotation 255, 355, wherein the holding member 210, 310 is arranged distanced D along a first axis A1 from the excentre arm center of rotation 255, 355, the first axis A1 forming an acute angle A with the holding plane A2 when in the locking position, the wire locking mechanism 300, 400, 600, 700 further comprising a control arm arrangement 360, the control arm arrangement 360 comprising an engagement surface 410 for engaging a cylinder cam 420, whereby, upon rotation of the locking mechanism body 530 to a pre-determined angle, the control arm arrangement 360 is configured to release the wire 230 from the wire locking mechanism 400, 700.

Other example features disclosed above which may be implemented independently from each other comprise a wire locking mechanism 200, 300, 400, 500, 600, 700 for a reinforcement bar, rebar, wire tying device 100, the locking mechanism comprising a holding member 210, 310 and a counter-holding member 220, 320 arranged to engage respective sides of a wire 230 to releasably hold the wire in a locking position, wherein the holding member 210, 310 and the counter-holding member 220, 320 are supported on a joining member 510, 610, wherein the joining member 510, 610 is rotatably supported on a fourth shaft 520, 620 to rotate in relation to a locking mechanism body 530 in response to a pull force F2 acting on the wire 230.

According to aspects, a holding force F1 exerted on the wire 230 by the holding member 210, 310 is normal to a holding plane A2, wherein the holding member 210, 310 is supported on a first end of an excentre arm 240, 340, the excentre arm 240, 340 being rotatably supported on a first shaft 250, 350 to rotate R1 about an excentre arm center of rotation 255, 355, wherein the holding member 210, 310 is arranged distanced D along a first axis A1 from the excentre arm center of rotation 255, 355, the first axis A1 forming an acute angle A with the holding plane A2 when in the locking position.

According to aspects, the holding member 310 comprises a first toothed wheel supported on a second shaft 313, and a catch arrangement 312 configured to lock the first toothed wheel when in the locking position.

According to aspects, the catch arrangement 312 is spring loaded towards a position to lock the first toothed wheel.

According to aspects, the first toothed wheel comprises teeth with a circumferentially blunt and/or essentially flat portion 311 configured to engage the wire 230 when in the locking position.

According to aspects, the counter-holding member 320 comprises a second toothed wheel rotatably supported on a third shaft 323.

According to aspects, the excentre arm 240, 340 is spring loaded towards the locking position.

According to aspects, the wire locking mechanism comprises a first actuator arranged to rotate the excentre arm 240, 340 about the excentre arm center of rotation 255, 355 in a first direction to separate the holding member 210, 310 from the counter-holding member 220, 320 when in a wire-infeed mode.

According to aspects, the wire locking mechanism comprises a second actuator arranged to rotate the excentre arm 240, 340 about the excentre arm center of rotation 255, 355 in a second direction opposite to the first direction to move the holding member 210, 310 into the locking position.

According to aspects, the excentre arm 240, 340 and the counter-holding member 220, 320 are supported on a joining member 510, 610, wherein the joining member 510, 610 is rotatably supported on a fourth shaft 520, 620 to rotate in relation to a locking mechanism body 530 in response to a pull force F2 acting on the wire 230.

According to aspects, the wire locking mechanism comprises a control arm arrangement 360, the control arm arrangement 360 comprising an engagement surface 410 for engaging a cylinder cam 420, whereby, upon rotation of the locking mechanism body 530 to a pre-determined angle, the control arm arrangement 360 is configured to release the catch arrangement 312, thereby placing the first toothed wheel 310 in a free rolling condition and releasing the wire 230 from the wire locking mechanism.

According to aspects, the engagement surface 410 for engaging the cylinder cam 420 comprises a cylindrical roller configured to traverse the cylinder cam 420.

According to aspects, the wire locking mechanism 300, 400, 600, 700 comprises a catch arrangement configured to lock the second toothed wheel when in the locking position.

There is also disclosed herein a wire locking mechanism 200, 300, 400, 500, 600, 700 for a reinforcement bar, rebar, wire tying device 100, the locking mechanism comprising a holding member 210, 310 and a counter-holding member 220, 320 arranged to engage respective sides of a wire 230 to releasably hold the wire in a locking position, wherein the holding member 310 comprises a first toothed wheel supported on a second shaft 313, and a catch arrangement 312 configured to lock the first toothed wheel when in the locking position, the locking mechanism further comprising a control arm arrangement 360, the control arm arrangement 360 comprising an engagement surface 410 for engaging a cylinder cam 420, whereby, upon rotation of the locking mechanism body 530 to a pre-determined angle, the control arm arrangement 360 is configured to release the catch arrangement 312, thereby placing the first toothed wheel 310 in a free rolling condition and releasing the wire 230 from the wire locking mechanism.

According to aspects, the engagement surface 410 for engaging the cylinder cam 420 comprises a cylindrical roller configured to traverse the cylinder cam 420.

According to aspects, a holding force F1 exerted on the wire 230 by the holding member 210, 310 is normal to a holding plane A2, wherein the holding member 210, 310 is supported on a first end of an excentre arm 240, 340, the excentre arm 240, 340 being rotatably supported on a first shaft 250, 350 to rotate R1 about an excentre arm center of rotation 255, 355, wherein the holding member 210, 310 is arranged distanced D along a first axis A1 from the excentre arm center of rotation 255, 355, the first axis A1 forming an acute angle A with the holding plane A2 when in the locking position.

According to aspects, the catch arrangement 312 is spring loaded towards a position to lock the first toothed wheel.

According to aspects, the first toothed wheel comprises teeth with a circumferentially blunt and/or essentially flat portion 311 configured to engage the wire 230 when in the locking position.

According to aspects, the counter-holding member 320 comprises a second toothed wheel rotatably supported on a third shaft 323.

According to aspects, the excentre arm 240, 340 is spring loaded towards the locking position.

According to aspects, the wire locking mechanism comprises a first actuator arranged to rotate the excentre arm 240, 340 about the excentre arm center of rotation 255, 355 in a first direction to separate the holding member 210, 310 from the counter-holding member 220, 320 when in a wire-infeed mode.

According to aspects, the wire locking mechanism comprises a second actuator arranged to rotate the excentre arm 240, 340 about the excentre arm center of rotation 255, 355 in a second direction opposite to the first direction to move the holding member 210, 310 into the locking position.

According to aspects, the excentre arm 240, 340 and the counter-holding member 220, 320 are supported on a joining member 510, 610, wherein the joining member 510, 610 is rotatably supported on a fourth shaft 520, 620 to rotate in relation to a locking mechanism body 530 in response to a pull force F2 acting on the wire 230.

According to aspects, the wire locking mechanism comprises a catch arrangement configured to lock the second toothed wheel when in the locking position.

The invention claimed is:

1. A wire locking mechanism for a reinforcement bar, rebar, wire tying device, the locking mechanism comprising a holding member and a counter-holding member arranged to receive a free end of a wire and to engage respective sides of the wire to releasably hold the wire in a locking position, wherein a holding force exerted on the wire by the holding member is normal to a holding plane, wherein the holding member is supported on a first end of an excentre arm, the excentre arm being rotatably supported on a first shaft to rotate about an excentre arm center of rotation, wherein a second shaft of the holding member is arranged distanced along a first axis from the excentre arm center of rotation, the first axis forming an acute angle with the holding plane when in the locking position, wherein at least one of the holding member and the counter-holding member comprises a rotatably supported toothed wheel, and wherein the holding member comprises a first toothed wheel rotatably supported on the second shaft, and a catch arrangement configured to lock the first toothed wheel when in the locking position, wherein the catch arrangement is spring loaded towards a position to lock the first toothed wheel.

2. The wire locking mechanism according to claim 1, wherein the counter-holding member comprises a second toothed wheel rotatably supported on a third shaft.

3. The wire locking mechanism according to claim 1, wherein the excentre arm is spring loaded towards the locking position.

4. The wire locking mechanism according to claim 1, comprising a first actuator arranged to rotate the excentre arm about the excentre arm center of rotation in a first direction to separate the holding member from the counter-holding member when in a wire-infeed mode, wherein the first actuator comprises a solenoid device.

5. The wire locking mechanism according to claim 1, comprising a second actuator arranged to rotate the excentre arm about the excentre arm center of rotation in a second direction opposite to the first direction to move the holding member into the locking position, wherein the second actuator comprises a solenoid device.

6. The wire locking mechanism according to claim 2, wherein the excentre arm and the counter-holding member are supported on a joining member, wherein the joining member is rotatably supported on a fourth shaft to rotate in relation to a locking mechanism body in response to a pull force acting on the wire.

7. The wire locking mechanism according to claim 1, comprising a control arm arrangement, the control arm arrangement comprising an engagement surface for engaging a cylinder cam, whereby, upon rotation of the locking mechanism body to a pre-determined angle, the control arm arrangement is configured to release the catch arrangement, thereby placing the first toothed wheel in a free rolling condition and releasing the wire from the wire locking mechanism.

* * * * *